US006901226B2

(12) United States Patent
Claassen

(10) Patent No.: US 6,901,226 B2
(45) Date of Patent: May 31, 2005

(54) POWER CONTROL FOR A XEROGRAPHIC FUSING APPARATUS

(75) Inventor: Franciscus Gerardus Johannes Claassen, Oploo (NL)

(73) Assignee: Xerox Corporation, Stamford, CT (US)

( * ) Notice: Subject to any disclaimer, the term of this patent is extended or adjusted under 35 U.S.C. 154(b) by 63 days.

(21) Appl. No.: 10/440,753

(22) Filed: May 19, 2003

(65) Prior Publication Data

US 2004/0234289 A1 Nov. 25, 2004

(51) Int. Cl.[7] ..... G03G 15/20
(52) U.S. Cl. ..... 399/67; 219/216; 399/69; 399/88; 432/60
(58) Field of Search ..... 399/67, 69, 328, 399/330, 88; 219/216, 469, 470; 432/60

(56) References Cited

U.S. PATENT DOCUMENTS 4,340,807 A 7/1982 Raskin et al. ..... 219/497
4,372,675 A 2/1983 Sahay
6,111,230 A * 8/2000 Cao et al. ..... 219/501
6,240,263 B1 * 5/2001 Watanabe et al. ..... 399/69
6,301,454 B1 10/2001 Nishida et al. ..... 399/69
6,353,718 B1 * 3/2002 Roxon et al. ..... 399/67
6,420,685 B1 * 7/2002 Tanamachi ..... 219/501
6,490,423 B2 12/2002 Horobin et al. ..... 399/67

* cited by examiner

*Primary Examiner*—William J. Royer
(74) *Attorney, Agent, or Firm*—R. Hutter

(57) ABSTRACT

In a xerographic printer including a fuser having a heating element, a first predetermined power level is applied to the heating element. The voltage associated with the heating element is measured, yielding an output code which is applied to a look-up table. The output of the look-up table relates to power to be applied to the heating element in a time interval T going forward: the output sets forth what power level is to be applied to the heating element for a smaller interval t within interval T, and what power level is to be applied to the heating element for the balance of the interval T.

8 Claims, 4 Drawing Sheets

POWER CONTROL FOR A XEROGRAPHIC FUSING APPARATUS

TECHNICAL FIELD

The present invention relates to a fusing apparatus, as used in electrostatographic printing, such as xerographic printing or copying, and methods of operating thereof.

BACKGROUND

In electrostatographic printing, commonly known as xerographic printing or copying, an important process step is known as "fusing." In the fusing step of the xerographic process, dry marking material, such as toner, which has been placed in imagewise fashion on an imaging substrate, such as a sheet of paper, is subjected to heat and/or pressure in order to melt or otherwise fuse the toner permanently on the substrate. In this way, durable images are rendered on the substrates.

Currently, the most common design of a fusing apparatus as used in commercial printers includes two rolls, typically called a fuser roll and a pressure roll, forming a nip therebetween for the passage of the substrate therethrough. Typically, the fuser roll further includes, disposed on the interior thereof, one or more heating elements, which radiate heat in response to a current being passed therethrough. The heat from the heating elements passes through the surface of the fuser roll, which in turn contacts the side of the substrate having the image to be fused, so that a combination of heat and pressure successfully fuses the image.

A design consideration which has recently become important in the office equipment industry is the avoidance of "flicker" with regard to a power system associated with the printing apparatus. "Anti-flicker" mandates, which basically require that the power consumption of the machine as a whole does not affect the behavior of other equipment, such as fluorescent lighting, within the same building, are of concern in many countries. Further, different countries have different power levels and AC frequencies associated with their wall outlets, and it is desirable to design a printing apparatus, particularly with regard to the fuser, that is suitable for different power supplies with minimum necessary modifications.

PRIOR ART

U.S. Pat. Nos. 4,340,807 and 4,372,675 disclose the use of AC "cycle stealing" for precise control of power supplied to a xerographic fusing apparatus.

U.S. Pat. Nos. 6,301,454 and 6,490,423 disclose systems for controlling power consumption by a fusing apparatus having multiple heating elements.

SUMMARY OF THE INVENTION

According to one aspect of the present invention, there is provided a method of operating a heating element useful in fusing marking material to a sheet, comprising applying to the heating element power at a first predetermined level, and measuring a voltage associated with the heating element. An output code is determined in response to the measuring, the output code defining, for a subsequent time interval, a proportion of the interval at which power is to be applied to the heating element at a second predetermined level.

DETAILED DESCRIPTION

Figure 1:
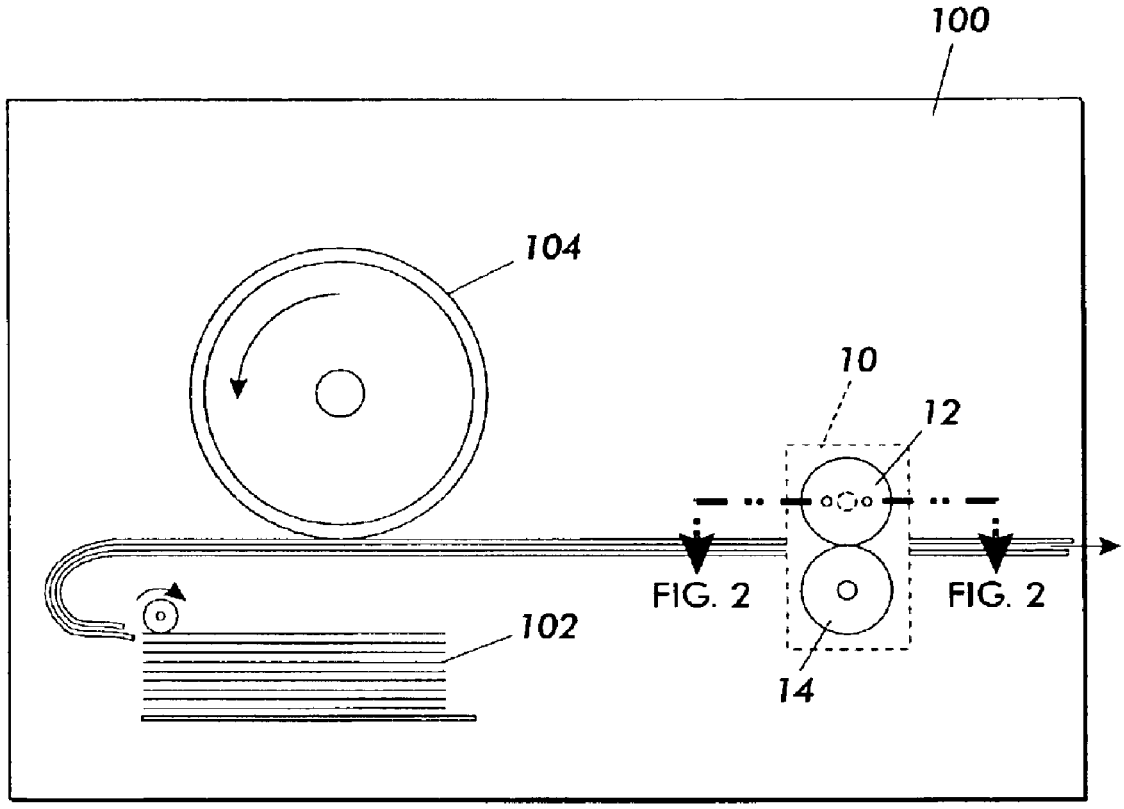
FIG. 1 PRIOR ART
FIG. 1 is a simplified elevational view showing the essential portions of an electrostatographic printer, such as a xerographic printer or copier, relevant to the present invention.

FIG. 1 is a simplified elevational view showing the essential portions of an electrostatographic printer, such as a xerographic printer or copier, relevant to the present invention. A printing apparatus 100, which can be in the form of a digital or analog copier, "laser printer," ionographic printer, or other device, includes mechanisms which draw substrates, such as sheets of paper, from a stack 102 and cause each sheet to obtain a toner image from the surface of a charge receptor 104, on which electrostatic latent images are created and developed through well-known processes. Once a particular sheet obtains marking material from charge receptor 104, the sheet (now a print sheet) is caused to pass through a fusing apparatus such as generally indicated as 10.

A typical design of a fusing apparatus 10 includes a fuser roll 12 and a pressure roll 14. Fuser roll 12 and pressure roll 14 cooperate to exert pressure against each other across a nip formed therebetween. When a sheet passes through the nip, the pressure of the fuser roll 12 against the pressure roll 14 contributes to the fusing of the image on a sheet. Fuser roll 12 further includes means for heating the surface of the roll, so that heat can be supplied to the sheet in addition to the pressure, further enhancing the fusing process. Typically, the fuser roll 12, having the heating means associated therewith, contacts the side of the sheet having the image desired to be fused.

Figure 2:
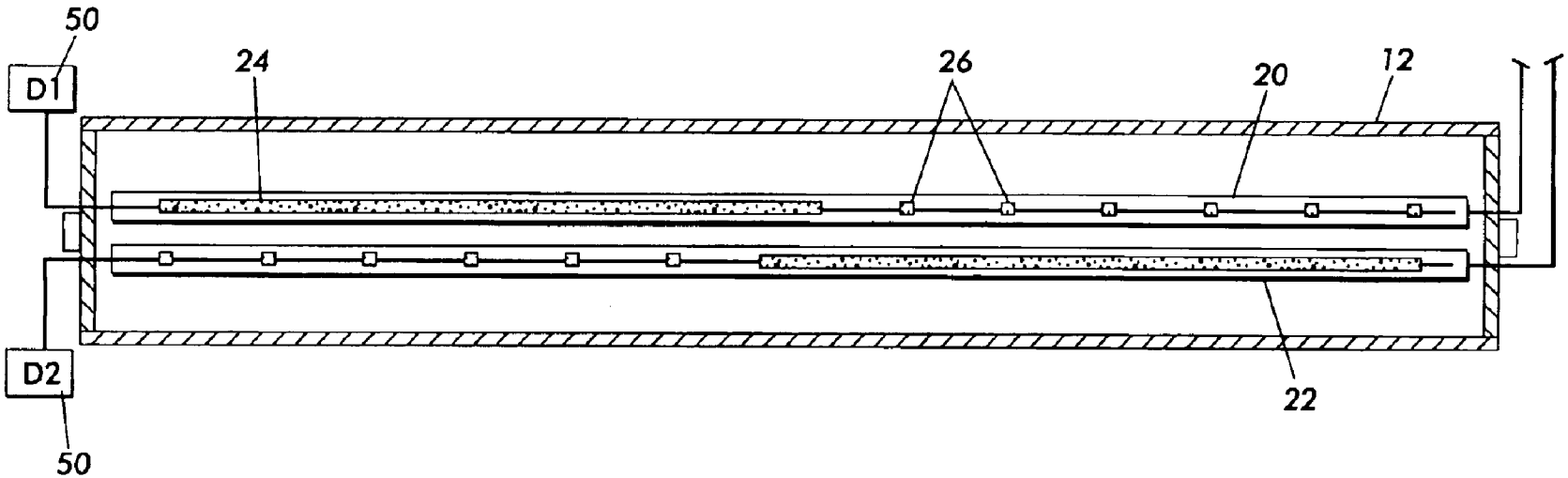
FIG. 2 PRIOR ART
FIG. 2 is a plan sectional view of the fuser roll as viewed through the line marked 2—2 in FIG. 1.

In a common design, fuser roll 12 includes one or more heating elements, so that heat generated by the heating elements will cause the outer surface of fuser roll 12 to reach a desired temperature. FIG. 2 is a sectional view of the fuser roll 12 as viewed through the line marked 2—2 in FIG. 1. As can be seen in FIG. 2, there is disposed within the interior of fuser roll 12 two heating elements, indicated as 20 and 22. The elements 20 and 22 are each disposed along the axial length of the fuser roll 12, and as such are disposed to be largely perpendicular to a direction of passage of the sheets passing through the nip of the fusing apparatus 10.

As can be seen in FIG. 2, each element, such as 20, includes a specific configuration of heat-producing material, in this particular case, a relatively long major portion of heat-producing material 24, along with a number of smaller portions of heat-producing material, indicated as 26, all of which are connected in series. It will be noted that, within each element such as 20 or 22, major portion 24 is disposed toward one particular end of the fuser roll 12, while the relatively smaller portions 26 are disposed toward the opposite end of the fuser roll 12. In a practical embodiment, the heat-producing material substantially comprises tungsten, while the overall structure of the element is borosilicate glass: these materials are fairly common in the fuser-element context.

Further according to an embodiment of the present invention, the two elements 20, 22 are disposed within the fuser roll 12 such that the relatively hot end of element 22 is adjacent the relatively cold end of element 20, and vice versa. Elements 20, 22 have substantially identical configurations of heat-producing material, and in the embodiment are oriented in opposite directions, as shown. In one embodiment, the two elements 20, 22 are powered by separate circuits, each circuit with its own driver 50.

Figure 3:
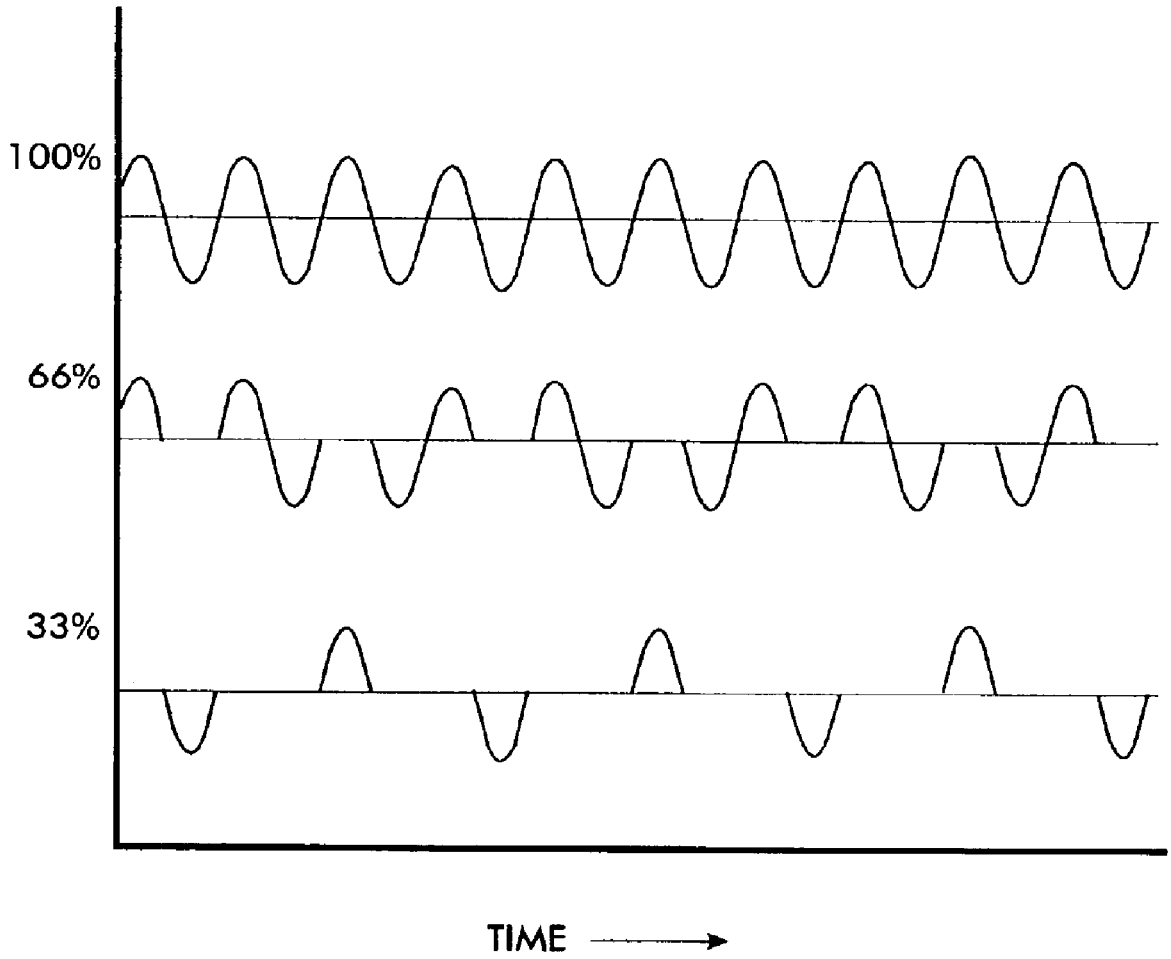
FIG. 3 PRIOR ART
FIG. 3 is a set of comparative waveforms showing the cycle stealing concept.

Various discrete power levels are applied to either heating element 20, 22 by applying, to each element 20, 22 as needed, a sinusoidal voltage having partial cycles missing therefrom on a periodic basis, or in other words a "cycle stealing" principle so that, partial power levels such as of 33% and 66% can be realized. FIG. 3 is a set of comparative waveforms showing how, if a 100% power level applied to an element is manifest in the form of a full sinusoidal waveform, the lower levels are manifest by cycle stealing relative to the full waveform. The waveform marked 33% is the same as the 100% waveform except that, for two out of every three half-cycles, or lobes in the waveform over time, are in effect removed from the supplied voltage. For the 66% power level, as shown in FIG. 3, one out of every three lobes or half-cycles is missing. The missing half-cycles, in this embodiment, occur on a regular basis over time.

Although the illustrated embodiment shows the discrete partial power levels in three steps, with one or two of every three half-cycles being missing, other embodiments could provide, for example, power up in two steps, with just one partial power level characterized by every other half-cycle missing; in four steps, with each of three partial power levels characterized by one, two, or three of every four half-cycles being missing; or other ways of achieving a desired number of partial power levels up to full power.

Figure 4:
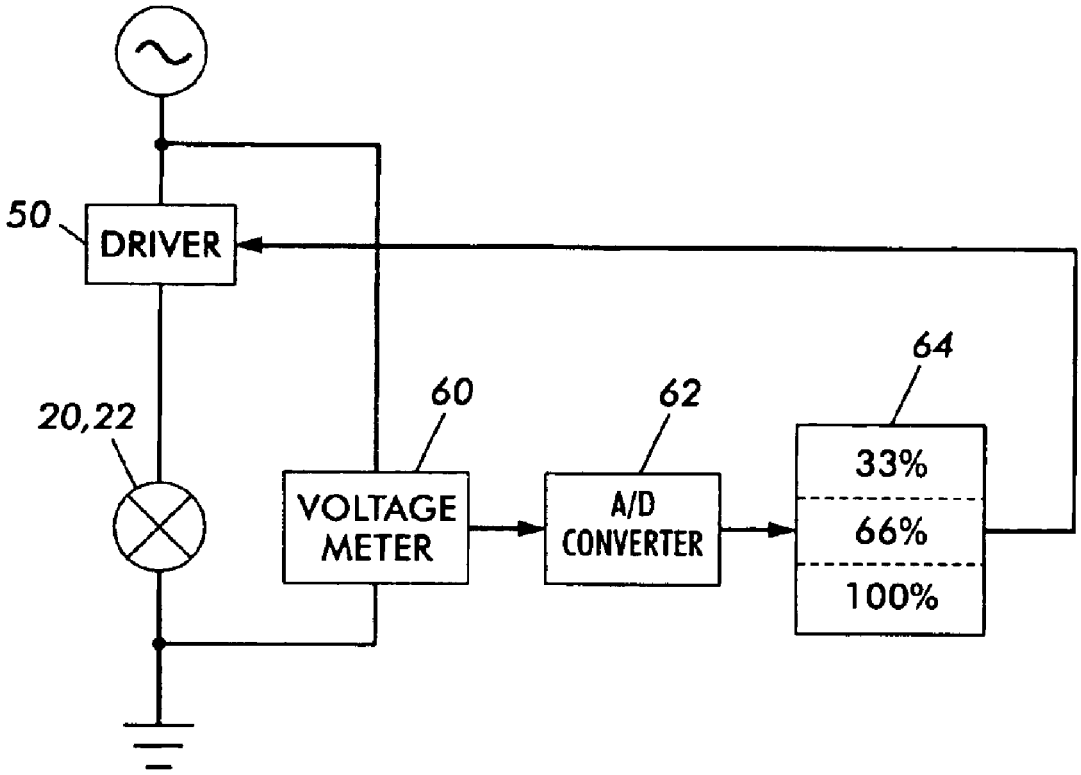
FIG. 4 is a schematic diagram showing one possible implementation of a power control system.

FIG. 4 is a diagram showing the operation of a power control system for operating each heating element 20, 22, in a manner which limits the line current entering the heating element 20, 22 so that the wall socket fuse limit is not exceeded. At various times in the power-up and continuing operating of the fusing apparatus 10, the AC power applied to each heating element 20, 22 is at one predetermined power level, such as 0%, 33%, 66%, or 100% power, these power levels being determined by the "cycle stealing" technique described above (although another method of controlling the applied power, such as controlling the voltage, can be used as well). According to this method, at a given known predetermined power level, with every half-cycle of the AC power, the actual value of the main voltage (being applied to the heating element 20 or 22) is measured, such as with voltmeter 60. This measured voltage yields a number which is converted, using an analog digital converter 62, into, in this embodiment, an eight-bit number related to the measured voltage.

Further as shown in FIG. 4, the eight-bit number is applied to a look-up table 64. The look-up table 64 has different sections depending on whether the power level being applied to the heating element 20, 22 at the time is 33%, 66%, or 100%; in effect, the input power level is another variable entered into the look-up table 64, in addition to the measured voltage.

The look-up table 64, having received these variables, then outputs what can be called an "output code," which is an instruction for operating the heating element 20, 22 in the immediate future, specifically in an interval T of a predetermined number of AC half-cycles going forward. According to this embodiment, the look-up table 64 includes 32 possible output codes, depending on the measured voltage, for each input power level. Each output code is an 8-bit number, in which: bits 6 and 7 relate to a predetermined power level (such as 33%, 66%, or 100%) to be applied within a smaller interval t, of a fixed proportion to the larger interval T; bits 5–2 define the length of interval t; and bits 0 and 1 relate to the power level to be applied to the heating element 20, 22 for the balance of interval T after smaller interval t. In short, the output code instructs the driver 50 to apply to a heating element such as 20 or 22, for a subsequent time interval T going forward, a first predetermined power level for a period t which is a proportion of interval T, and a second predetermined power level for the rest of interval T. (It is conceivable that the first and second predetermined power levels are the same under certain conditions.)

Figure 5:
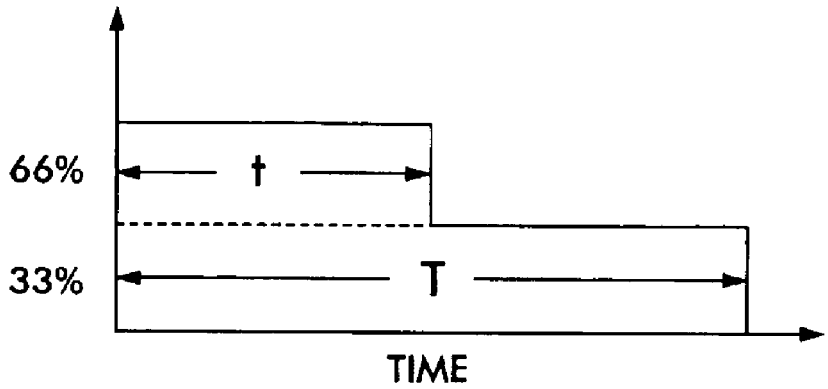
FIG. 5 is a simple diagram of an example control over a power level.

FIG. 5 is a simple diagram of an example control over the power level for an interval T, which in this example, is instructed to be held at 66% for a predetermined proportion t of interval T. For the balance of interval T in this example, the power level is intended, as instructed by the output code, to be held at 33%. Although the proportion t is shown as being at the beginning of the interval T, it is conceivable that such a proportion could be defined (such as by the output code) as being at the end or in the middle of interval T, or otherwise distributed in a predetermined manner within interval T.

In one practical embodiment, the look-up process occurs with every three AC half-cycles. A typical duration of T is 600 msec but any duration between 100 msec and several seconds could also be possible. The driver 50 can include means, such as an opto-triac (not shown), for effecting the cycle-stealing techniques for obtaining the desired power levels for the intervals t and T as instructed via the output code.

A practical advantage of the present embodiment is that the maximum average current applied to a heating element can be set to just below the wall socket fuse limit under all line voltage conditions, so that the maximum available main power level can be utilized as needed. The embodiment can thus be useful for both avoiding flicker with regard to other electrical devices within a building, and also for providing a fuser which can be used with a range of wall outlet voltages and frequencies with minimal adaptation.

What is claimed is:

1. A method of operating a heating element useful in fusing marking material to a sheet, comprising:

applying to the heating element power at a first predetermined level;

measuring a voltage associated with the heating element; and determining an output code in response to the measuring, the output code defining, for a subsequent time interval, a proportion of the interval at which power is to be applied to the heating element at a second predetermined level.

2. The method of claim 1, further comprising applying power to the heating element according to the output code.

3. The method of claim 1, wherein the first predetermined level is distinguished from the second predetermined level by a proportion of missing AC half-cycles.

4. The method of claim 1, wherein the subsequent time interval has a duration of a predetermined number of AC half-cycles applied to the heating element.

5. The method of claim 1, wherein the determining includes applying a number related to the measured voltage to a look-up table.

6. The method of claim 1, wherein the determining includes applying a number related to the first predetermined level to a look up table.

7. The method of claim 1, wherein the output code includes instructions relating to a power level to be applied to the heating element for a balance of the interval besides the proportion.

8. The method of claim 1, wherein the proportion of the interval occurs at a beginning of the interval.

* * * * *